United States Patent [19]

Kobayashi

[11] 4,265,091

[45] May 5, 1981

[54] REFRIGERANT COMPRESSOR PROTECTING DEVICE

[75] Inventor: Hisao Kobayashi, Kariya, Japan

[73] Assignee: Kabushiki Kaisha Toyoda Jidoshokki Seisakusho, Kariya, Japan

[21] Appl. No.: 142,622

[22] Filed: Apr. 21, 1980

[30] Foreign Application Priority Data

Jun. 7, 1979 [JP] Japan ..... 54-71546

[51] Int. Cl.[3] ..... F25B 49/00; F25B 1/00; F04B 49/10

[52] U.S. Cl. ..... 62/126; 62/129; 62/228; 417/32

[58] Field of Search ..... 62/125, 126, 129, 228 R; 417/19, 32, 9

[56] References Cited

U.S. PATENT DOCUMENTS

| | | | |
|---|---|---|---|
| 3,232,519 | 2/1966 | Long | 417/19 X |
| 3,278,111 | 10/1966 | Parker | 417/32 |
| 4,059,366 | 11/1977 | Gannaway | 417/32 |
| 4,167,858 | 9/1979 | Kojima et al. | 62/126 |
| 4,220,010 | 9/1980 | Mueller et al. | 417/32 X |

FOREIGN PATENT DOCUMENTS

| | | | |
|---|---|---|---|
| 2453052 | 5/1976 | Fed. Rep. of Germany | 417/32 |

*Primary Examiner*—William E. Wayner
*Assistant Examiner*—Harry Tanner
*Attorney, Agent, or Firm*—Browdy & Neimark

[57] ABSTRACT

A device for protecting a refrigerant compressor against troubles resulting from shortage of the refrigerant, including two temperatures sensing units so disposed as to monitor temperatures of compressor outer wall or of the refrigerant near inlet and outlet of the compressor. Outputs from the two temperature sensing units are applied to inputs of a judging unit which generates a signal in the event it judges a refrigerant amount is insufficient through examining the inputs against a specific relationship known between the inlet and outlet temperatures as measured while the refrigerant amount is held at a predetermined lower limit. The signal is then transferred to a working means which automatically turns off the compressor and/or takes other proper actions necessary for protecting the compressor.

11 Claims, 7 Drawing Figures

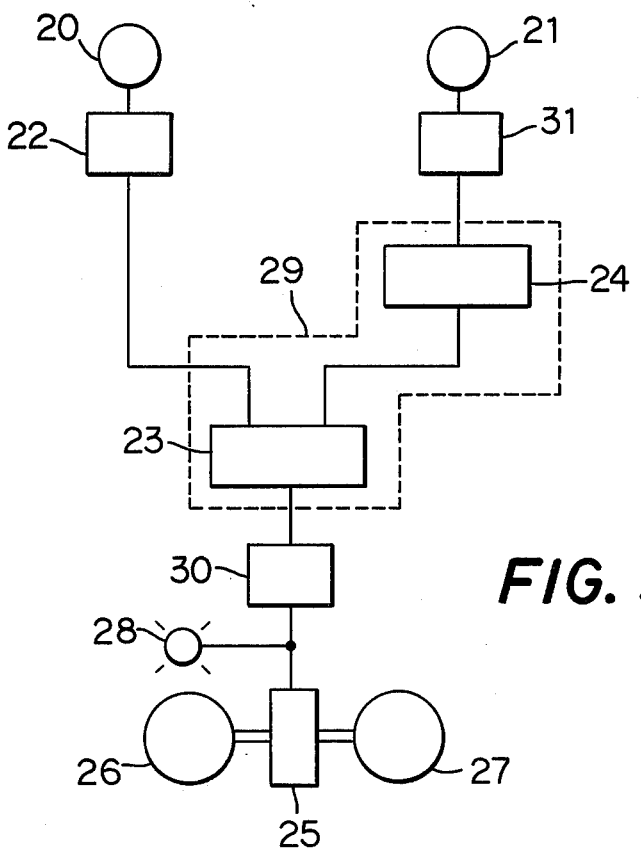
FIG. 3
FIG. 5
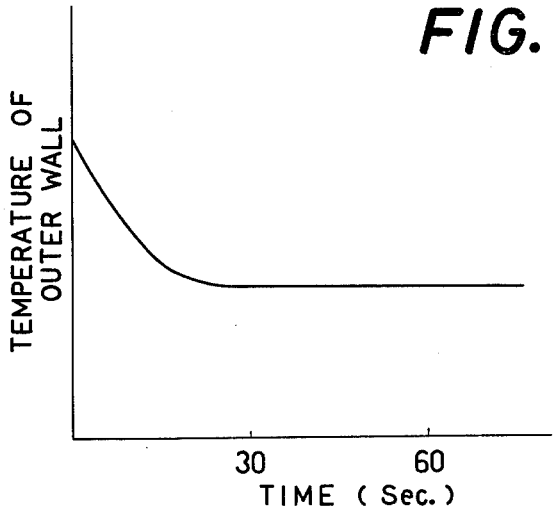

REFRIGERANT COMPRESSOR PROTECTING DEVICE

BACKGROUND OF THE INVENTION

1. Field of the Invention

The present invention relates to a compressor as generally used in an air conditioning or cooling system to compress a refrigerant enclosed and circulating therein. More particularly, the invention is concerned with a device for protecting such refrigerant compressor against overheating, seizure and other troubles, being capable of detecting a critical loss of the refrigerant due to its possible leak from the refrigeration system by examining the refrigerant or compressor outer wall temperatures as monitored near inlet and outlet of the compressor against a specific relationship known between the inlet and outlet temperatures.

2. Description of the Prior Art

In a common mechanical compression refrigeration system, the refrigerant is circulated therein by a compressor repeating a refrigeration cycle wherein the refrigerant is condensed from a vapor state to a liquid state and the liquid refrigerant is then changed into a vapor while passing through an evaporator, removing heat from and thus cooling the surrounding air. The compressor is so connected to the refrigeration circuit as to admit the low-pressure vaporous refrigerant and discharge it after compression thereof to an elevated pressure.

In the event the refrigerant amount was decreased due to a leakage flow from the refrigeration circuit, the effect of the refrigerant to cool the compressor mechanism would be accordingly reduced, causing the compressor to be overheated, or even seized particularly in case the compressor uses a lubrication oil in the form of a spray mist to be contained in the refrigerant as a mixture. This is because the amount of lubricant to be delivered to the compressor is necessarily reduced as the amount of the refrigerant acting as an oil carrier is decreased.

To prevent such kinds of serious troubles occuring with the compressor, it has been considered necessary to monitor the refrigerant amount, and stop the compressor in the event the refrigerant amount falls below a predetermined lower limit. Hitherto, two common methods have been known to detect insufficiency of the refrigerant. The first of these is to monitor the refrigerant temperature which is known to rise in response to decrease of the refrigerant amount. The second method is to monitor the temperature of an oil pan provided in the bottom portion of the compressor.

Either of these methods indicated above, however, is not completely satisfactory in that the monitored temperature of the refrigerant or of the oil pan is not responsive accurately enough to faithfully reflect a reducing amount of the refrigerant. Thus, these proposed methods may often fail to detect a fall of the refrigerant amount below the predetermined minimum level, and are not effective enough to prevent the serious seizure trouble with the compressor.

SUMMARY OF THE INVENTION

To overcome the indicated disadvantages and inabilities of the prior art and find alternative solutions thereof, the inventors of this invention had made intensive research and investigation, and as a result found the fact that there exists a specific relationship (normally expressed by a linear equation) between the temperature of the refrigerant or an outer wall as measured near a suction port of the compressor and that of the same as measured near a discharge port of the compressor, the former temperature rising substantially in direct proportion to the latter regardless of an operating speed of the compressor. Another fact revealed by the research and investigation is that the temperature of the refrigerant or compressor outer wall near the suction port will rise as the amount of refrigerant to be sucked into the compressor is reduced provided the temperature of the same near the discharge port is fixed or conversely, the latter temperature is lowered as the refrigerant amount is reduced provided the former is fixed.

In light of the facts stated above, it is understood that it is possible to detect insufficiency of the refrigerant by means of the temperatures of the refrigerant or compressor outer wall as measured near the suction and discharge ports of the compressor. In concrete words, the currently existing refrigerant amount in the refrigeration circuit may be judged as either sufficient or insufficient in such manner that a specific relationship between the stated two temperatures with the refrigerant amount held at a predetermined lower limit, is obtained in a line drawn on a coordinate system wherein the line is utilized as a boundary to classify coordinate points determined by the pair of actually monitored inlet and outlet temperature values, into two separate regions; one indicating the refrigerant amount is sufficient, and the other indicating it is insufficient.

Accordingly, the object of this invention is to provide a device, for effectively protecting a refrigerant compressor against overheating and/or seizure resulting from shortage of the refrigerant, that is accurately responsive to a decrease of the refrigerant amount in the refrigeration circuit. The protecting device for a refrigerant compressor in accordance with this invention includes two temperature sensing units; one for monitoring the temperature of the refrigerant or compressor outer wall at a point near the compressor inlet, and the other for monitoring the temperature of the same at a point near the compressor outlet, a judging unit which generates a signal to indicate insufficiency of the refrigerant amount in the event the coordinate point determined by the outputs of the two temperature sensing units was found to be located in the refrigerant-insufficiency region of the coordinates, which is separated from the refrigerant-sufficiency region by a border line pre-obtained from a known relationship between the inlet and outlet temperatures as measured with the refrigerant amount set at a minimum required level, and a working means which, upon reception of the signal from the judging unit, provides a positive warning to indicate a critical amount of loss of the refrigerant, and/or turns off the compressor automatically thus protecting the compressor against overheating and seizure resulting from a leak of the refrigerant from the refrigeration circuit.

Other objects and advantages of the invention will be apparent to those skilled in the art from the following detailed description of the preferred embodiment, the accompanying drawings and the appended claims.

BRIEF DESCRIPTION OF THE DRAWINGS

The invention is illustrated and disclosed in the accompanying drawings wherein:

FIG. 3 is a block diagram showing a preferred embodiment of the protecting device of this invention;

FIG. 5 is graph representing the compressor outer wall temperature varying with the time elapsed after initial start of the compressor;

DETAILED DESCRIPTION OF THE PREFERRED EMBODIMENTS

Figure 1:
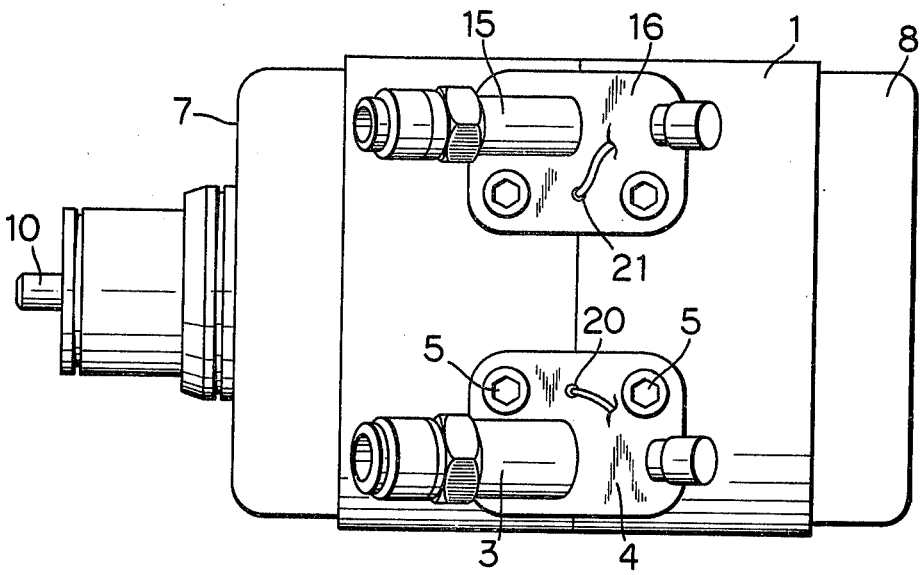
FIG. 1 is a plan view of a refrigerant compressor incorporating a preferred embodiment of the present invention.
Figure 2:
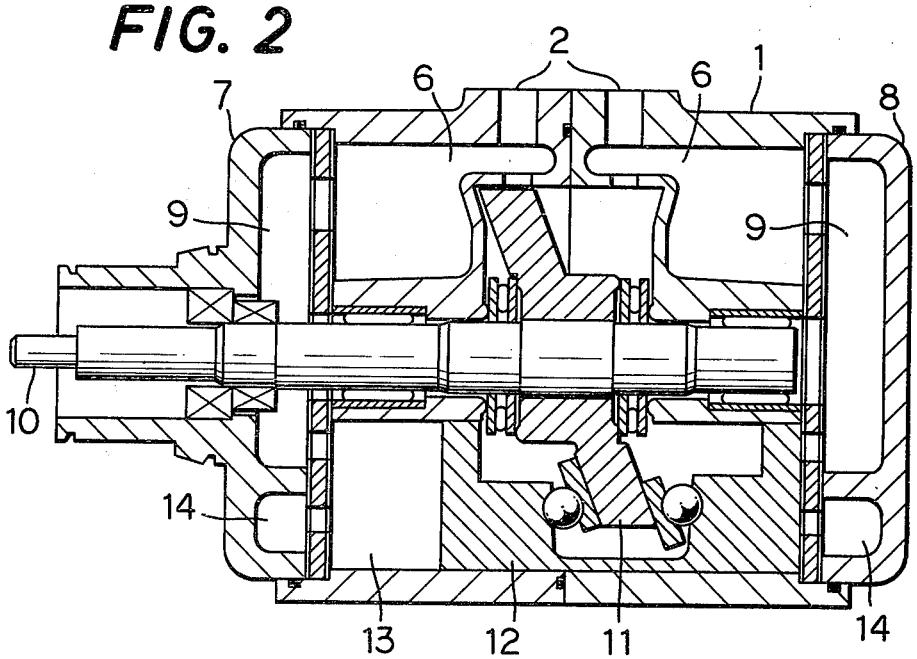
FIG. 2 is a sectional side elevation of the compressor shown in FIG. 1.

Referring now more particularly to the accompanying drawings which illustrate and disclose the exemplary embodiment of this invention for use with a vehicle air conditioning compressor of swash-plate type, there is shown the compressor in FIGS. 1 and 2, wherein an enclosure casing 1 has a suction port 2 in the longitudinally central and transversely left-hand side portion of its top. A flange 4 is so fixed to the casing 1 with screws 5 as to connect a suction tube fitting 3 formed as an integral part of the flange 4 to the suction port 2, allowing a refrigerant to be introduced into the compressor. The refrigerant admitted through the suction port 2 is then directed to suction chambers 9 situated within a front housing 7 and a rear housing 8, via respective suction passages 6 formed within the casing 1. The refrigerant introduced into the suction chambers 9 is drawn into a cylinder bore 13, compressed therein and discharged to discharge chambers 14 located also within the front and rear housings 7 and 8, by a piston 12 which is reciprocated longitudinally within the cylinder bore 13 by means of a swash plate 11 rotating together with a shaft 10 on which it is mounted. From the discharge chambers 14, the refrigerant is fed through passages formed within the casing 1 up to a discharge port located almost symmetrically to the suction port 2, i.e., at the longitudinally central and transversely biased portion of the casing top. A flange 16 is so bolted to the casing 1 as to connect a discharge tube fitting 15 formed as an integral part of the flange 16 to the discharge port.

Temperature sensing elements 20 and 21 are attached to the suction and discharge port flanges 4 and 16, respectively. The output of the suction port temperature sensing element 20 is transferred to a comparator 23 after it is amplified by a thermometer circuit 22, as shown by a block diagram in FIG. 3.

On the other hand, the output of the discharge port temperature sensing element 21 is amplified by a thermometer circuit 31 and transferred to an arithmetic circuit 24 by which the amplified output from the thermometer circuit 31 is converted into a temperature corresponding to that of an outer wall of the compressor as measured near the suction port, in accordance with a pre-obtained algebraic equation defining a known relationship between the two temperatures of the outer wall as measured near the suction and discharge ports while the refrigerant amount is held at a predetermined lower limit. The equation is obtainable in the following manner.

Figure 4:
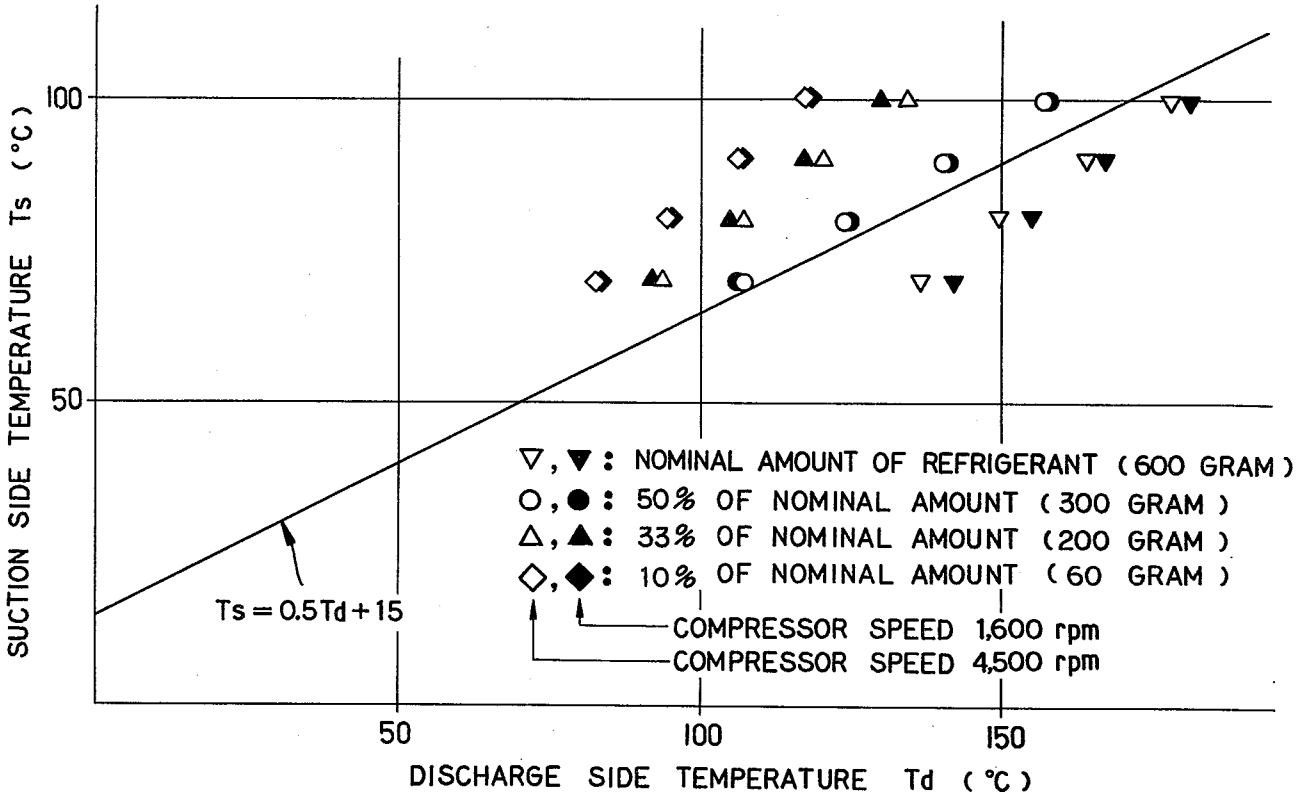
FIG. 4 is a graphical representation of relationships between the temperatures of an outer wall of the compressor as measured near the inlet and outlet while changing the refrigerant amount to different percentages of the nominal value.

A graphical representation in FIG. 4 indicates relationships between the temperature of the outer wall of the swash-plate type compressor as measured near the suction port and that as measured near the discharge port while the refrigerant amount is changed to different percentages of the nominal value. The vertical base line or ordinate of the graph is used to describe the suction side temperature, while the horizontal base line or abscissa is used for the discharge side temperature. If the minimum required refrigerant amount is set at a point slightly over the 50% (300 g) level and the approximate temperatures in that condition are to be expressed by a linear equation "$Ts=a\cdot Td+b$", the value "a" is obtained as 0.5 and the value "b" as 15, where "Ts" stands for the temperature near the suction port, and "Td" represents the temperature near the discharge port.

The output of the arithmetic circuit 24 which operates in conformity with the above equation, is fed to the comparator 23 by which the result of arithmetic operation is compared with the output of the suction port temperature sensing element 20. The comparator 23 generates a signal if the output of the suction side element 20 exceeds the output of the arithmetic circuit 24. Thus, the refrigerant amount is judged as insufficient or not by a judging unit 29 comprising the arithmetic circuit 24 and the comparator 23. In the event the refrigerant amount was judged as insufficient and the signal was generated from the judging unit 29, a clutch mechanism 25 would be operated to disconnect the compressor 27 from its drive source, that is, a vehicle engine 26. At the same time, the signal is transmitted to a warning light 28 to illuminate it informing the vehicle driver that the compressor has been stopped due to insufficiency of the refrigerant.

A time delay circuit 30 is employed to provide a proper time interval from the start of the compressor until the outer wall temperature falls from an ambient or higher-than-ambient level down to the normal or stationary operating level, during which the compressor stop signal of the judging unit 29 is prevented from reaching the clutch 25. The optimum time interval is found to be 30 seconds according to the wall temperature vs. time curve as presented in FIG. 5. The time delay circuit may use, for example, a C-R timer which is a combination of a capacitor and a resistor.

In the compressor protecting device of such arrangements as stated, the refrigerant amount is judged as insufficient in case the temperature of the compressor wall near the suction port exceeds values on the border or reference line determined from the temperature near the discharge port as measured while the refrigerant amount is held at the predetermined lower limit as previously indicated. In other words, the amount is judged as insufficient in the event the coordinate point determined by the temperatures detected by the suction and discharge side temperature sensing elements 20 and 21, is found to be situated in the refrigerant-insufficiency region of the coordinates, which is separated from the refrigerant-sufficiency region by the border line defined by the previously stated equation. If the coordinate point is situated in the refrigerant-insufficiency region, a positive warning is automatically provided and other necessary steps including an action to turn off the compressor are taken.

Figure 6:
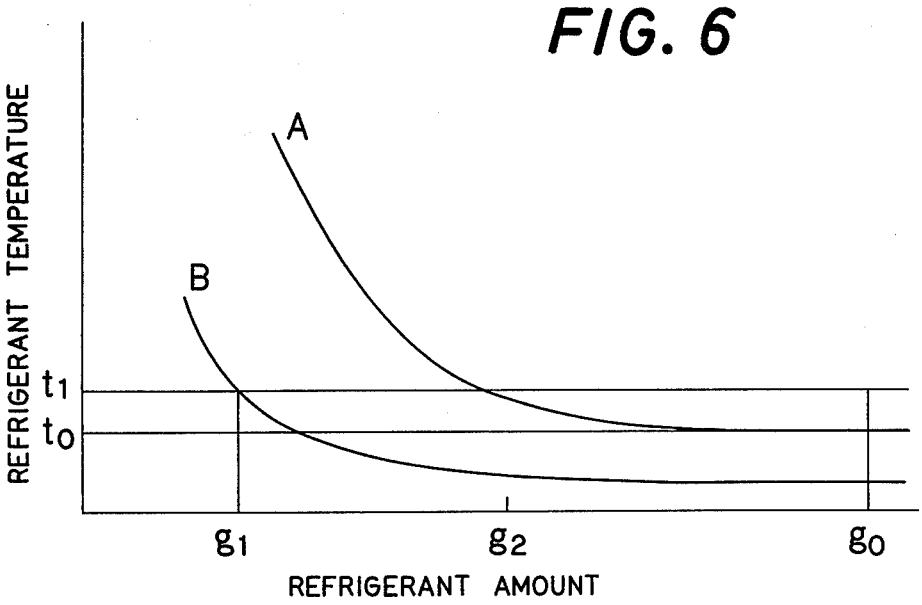
FIG. 6 is a graph showing a relationship between the temperature and amount of the refrigerant.
Figure 7:
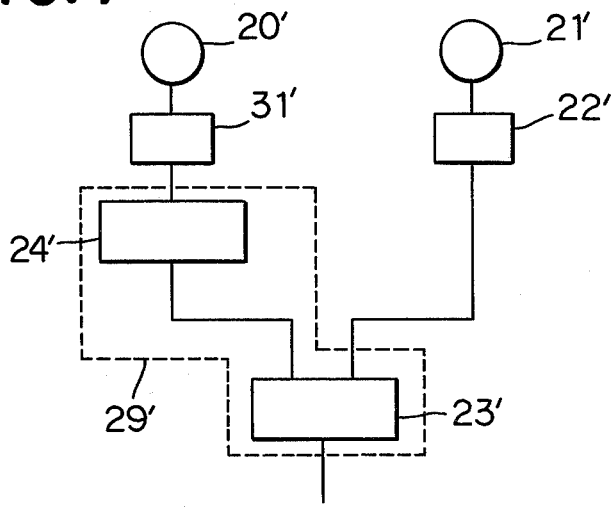
FIG. 7 is a block diagram presenting another preferred embodiment of the invention.

As stated, the lower limit of the refrigerant amount which is used as the reference for making the judgement, is set at a point slightly greater than 50% of the nominal value. This particular setting can be recognized as quite reasonable by referring to a graph in FIG. 6 which indicates, for comparison purpose, the ability of the conventional method to detect a decrease of the refrigerant from its temperature. In the graph, a curve A shows the relationship between the refrigerant temperature and amount when the compressor is operated under a heavy load, while a curve B shows the same relationship while in a light-load operation of the compressor. In a heavy-load operation, the refrigerant temperature is held at the $t_0$ level if the amount is a nominal value ($g_0$ gram) as shown by the curve A. If the lower limit of the refrigerant amount required to maintain normal operation of the refrigerating system under a heavy load is to be detected when the refrigerant temperature is elevated to $t_1$ °C., the lower limit of the amount surely detectable at the $t_1$ °C. while in a light-load operation is shifted down to the $g_1$ gram which is far less than the $g_2$ level (slightly over 50 percent of the nominal value), as shown by the curve B. Therefore, the ability of the conventional method to detect the lower limit of the amount from the temperature of the refrigerant is comparatively low.

In contrast to the indicated embodiment wherein the refrigerant amount is judged as insufficiently by comparing the temperature of the compressor wall near the suction port with the values on a border line which are obtained from the temperature of the same near the discharge port, it is also possible to make the judgement by comparing the discharge side temperature with the values on a border line which are obtained from the suction side temperature. In such case, an arithmetic circuit 24' which performs arithmetic operations in accordance with the equation "$Td=1/a\ (Ts-b)$", is so connected as to receive the output of a suction side temperature sensing element 31', and the refrigerant amount is judged as insufficient if the temperature of the outer wall detected by a discharge side temperature sensing element 21' is less than the result of operation by the arithmetic circuit 24'.

The proportional relationship as found between the temperatures of the outer wall of the compressor near the inlet and outlet, is known to be present also between the temperatures of the refrigerant near the compressor inlet and outlet. Hence, the temperature sensing elements used in the previous embodiment to detect insufficiency of the refrigerant, may be disposed in such portions of refrigerant flow passages of the refrigeration system in question that permit the elements to monitor the temperatures of the refrigerant itself near the suction and discharge ports of the compressor, respectively.

In the case the compressor is driven by an electric motor as is often seen in a refrigerator or a room air conditioning system, the motor may be turned off by an electric signal generated by the judging unit 29.

While the form of a compressor protecting device herein shown and described constitutes a preferred embodiment of the invention wherein the compressor is automatically turned off by a signal generated by the judging unit 29, it is to be understood that the invention is not limited to this precise form, and that changes and modifications may be made therein without departing the spirit and scope of the invention as expressed in the appended claims. For an example, it will be clear to those skilled in the art that a visible warning light or an audible signal may be used to indicate shortage of the refrigerant and thus advise the operator to manually turn off the compressor with use of a disconnect switch.

From the foregoing description, it will be obvious that the compressor protecting device in accordance with this invention is so designed and arranged as to monitor the temperatures of the compressor outer wall or of the refrigerant near the suction and discharge ports, and highly capable of judging the refrigerant amount as insufficient owing to a specific relationship known between the indicated two temperatures and the refrigerant amount, thereby effectively protecting the compressor against overheating, seizure and other troubles therof due to shortage of the refrigerant.

What is claimed is:

1. A device for protecting a compressor connected to a refrigeration circuit charged with a refrigerant to compress said refrigerant, comprising:

an inlet temperature sensing unit for monitoring temperature of a suction port of said compressor;

an outlet temperature sensing unit for monitoring temperature of a discharge port of said compressor;

a judging unit for judging a refrigerant amount as insufficient and generating a signal to indicate the insufficiency in the event a coordinate point determined by outputs of said two temperature sensing units was located in a refrigerant-insufficiency region of coordinates, said refrigerant-insufficiency region being separated from a refrigerant-sufficiency region by a line obtained and expressing a specific relationship known between the inlet and outlet temperatures as measured while the refrigerant amount is held at a predetermined lower limit; and a working means for taking action necessary to protect said compressor against troubles resulting from shortage of the refrigerant, upon reception of said signal generated from said judging unit.

2. A device according to claim 1, wherein said inlet temperature sensing unit is so disposed at said suction port that its sensitive element is exposed directly to the refrigerant flowing near the suction port to monitor temperature thereof.

3. A device according to claim 1, wherein said inlet temperature sensing unit is so disposed at said suction port that its sensitive element is put in direct contact with a portion of an outer wall of the compressor near the suction port to monitor temperature thereof.

4. A device according to claim 1, wherein said outlet temperature sensing unit is so disposed at said discharge port that its sensitive element is exposed directly to the refrigerant flowing near the discharge port to monitor temperature thereof.

5. A device according to claim 1, wherein said outlet temperature sensing unit is so disposed at said discharge port that its sensitive element is put in direct contact with a portion of said outer wall near the discharge port to monitor temperature thereof.

6. A device according to claim 1, wherein said working means is a warning unit generating a perceptible signal.

7. A device according to claim 1, wherein said working means is an apparatus automatically turning off the compressor.

8. A device according to claim 7, wherein said compressor is driven, via a clutch, by an engine of a vehicle and said clutch functions as said working means by disconnecting said compressor from said engine.

9. A device according to claim 7, wherein said compressor is driven by an electric motor and said working means is means for interrupting power to said electric motor.

10. A device according to claim 1, further comprising a delay circuit for delaying the signal from said judging unit by a predetermined time duration which is required from the starting of said compressor to a substantially stationary state, whereby said compressor can be prevented from a turning off which may occur immediately after its starting, inspite of sufficient amount of refrigerant being kept therein.

11. A device according to claim 1, wherein said compressor is a swash-plate type compressor which comprises a casing, a plurality of pistons reciprocatively disposed in said casing and a rotating swash-plate for actuating said pistons, and said suction port and said discharge port are disposed on the top of said casing symmetrically with each other in relation to the axis of said casing.

* * * * *

UNITED STATES PATENT AND TRADEMARK OFFICE

CERTIFICATE OF CORRECTION

PATENT NO. : 4,265,091

DATED : May 5, 1981

INVENTOR(S) : KONO et al

It is certified that error appears in the above-identified patent and that said Letters Patent are hereby corrected as shown below:

[75] Inventor: should read --Hiroya Kono, Kariya, Japan, Jun Hasegawa, Kariya, Japan, Mitsukane Inagaki, Anjyo, Japan, Hisao Kobayashi, Kariya, Japan--

Signed and Sealed this

*Twenty-fifth* Day of *August 1981*

[SEAL]

*Attest:*

GERALD J. MOSSINGHOFF

*Attesting Officer*

*Commissioner of Patents and Trademarks*